US006935509B2

(12) United States Patent
Egresitz

(10) Patent No.: US 6,935,509 B2
(45) Date of Patent: Aug. 30, 2005

(54) RECEPTACLE FOR TRAY DISPLAY

(75) Inventor: Richard Robert Egresitz, West Milford, NJ (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 319 days.

(21) Appl. No.: 10/330,919

(22) Filed: Dec. 27, 2002

(65) Prior Publication Data

US 2004/0124120 A1 Jul. 1, 2004

(51) Int. Cl.[7] ..... B65D 5/52

(52) U.S. Cl. ..... 206/756; 206/736; 206/769; 206/775; 229/120.36; 229/178; 229/242

(58) Field of Search ..... 206/736, 745, 206/756, 769, 775, 779, 781, 782; 229/242, 120.36, 120.38, 178

(56) References Cited

U.S. PATENT DOCUMENTS 1,803,861 A * 5/1931 Burdette ..... 206/769
1,911,678 A * 5/1933 Dunn ..... 206/730
3,002,608 A * 10/1961 Zwickey ..... 206/763
3,835,989 A * 9/1974 Mori et al. ..... 206/769
4,809,847 A * 3/1989 Schneider ..... 206/45.28
5,505,371 A * 4/1996 O'Neill ..... 229/120.26
6,712,214 B1 * 3/2004 Wintermute et al. ..... 206/745

OTHER PUBLICATIONS

Exhibit 1–"Point of Purchase Design Manual–The 42nd Merchandising Awards No. 7" published by the Point of Purchase Advertising Institute, 2000, miscellaneous pages illustrating point of purchase displays.

Four sheets of drawings of a point of purchase display, manufactured and offered for sale by Smurfit–Stone Cont. Corp. ca. Mar. 1, 2002.

Four sheets of drawings of a point of purchase display, manufactured and offered for sale by Smurfit–Stone Cont. Corp. ca. Feb. 15, 2002.

Three sheets of drawings of a point of purchase display, manufactured and offered for sale by Smurfit–Stone Con. Corp. ca. Jun. 22, 2002.

* cited by examiner

*Primary Examiner*—John A. Ricci
(74) *Attorney, Agent, or Firm*—Armstrong Teasdale LLP

(57) ABSTRACT

A receptacle for a tray display for point-of-purchase display of articles for vending, is provided with an outer shell, and an article enclosing tray positioned against a back side of a front wall of the outer shell. Access to the articles is provided through an aperture in the front wall.

13 Claims, 15 Drawing Sheets

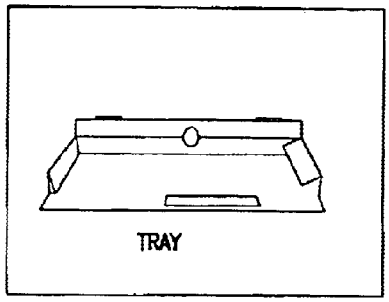

1 Fold up sides of tray as shown.

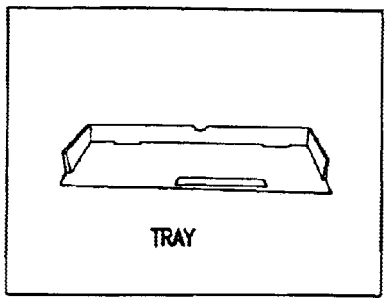

2 Fold up front of tray as shown, locking tabs into slots.

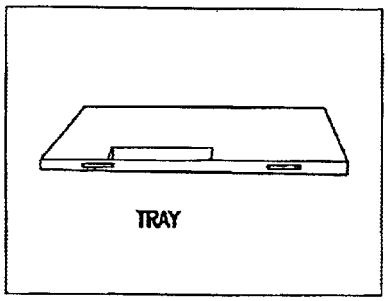

3 Add twinstick tape to top flap of tray as shown.

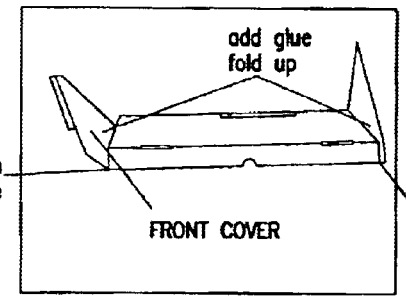

4 Place tray into front cover. Use location scores to register. Place glue on sides of tray. Press flaps of cover to secure.

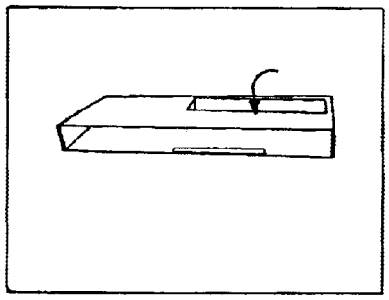

5 Turn unit over. Fold front flap of cover down, locking tabs into slots.

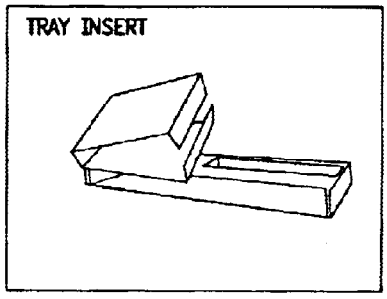

6 Fold tray insert as shown.

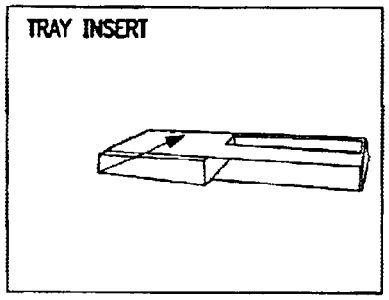

7 Slide insert into tray from top as shown.

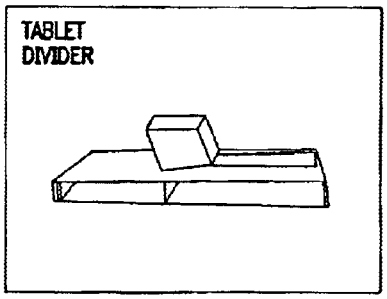

8 Form tablet divider as shown.

FIG. 15

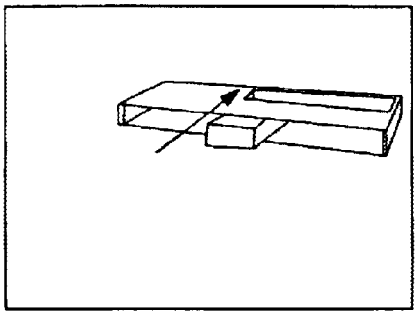

9 Slide divider down into tray next to insert.

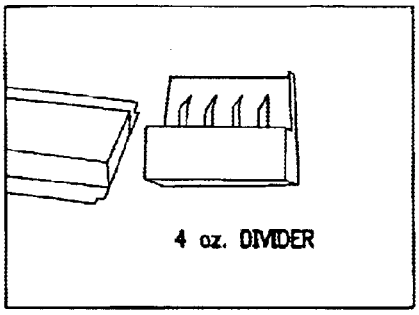

10 Form 4oz. divider as shown.

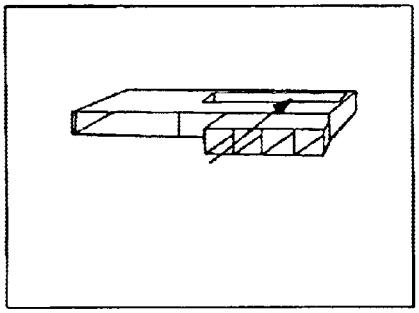

11 Slide divider down into tray above shelf.

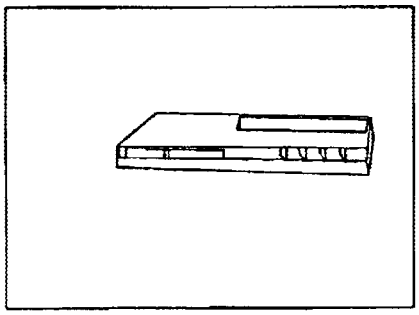

12 Peel tape off top flap of tray as shown.

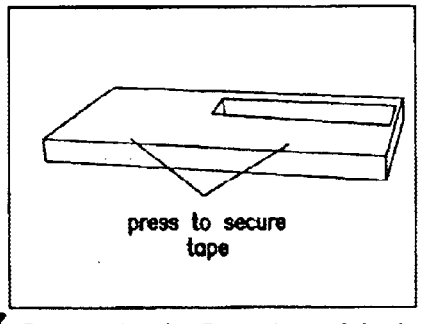

13 Fold top flap in. Press down of front cover to secure tape.

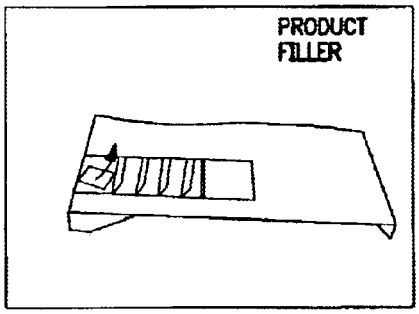

14 Slide product filler in and up cell on far left of unit. Add product.

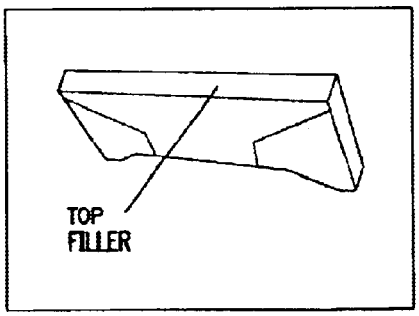

15 Place U shaped top filler on top of each unit.

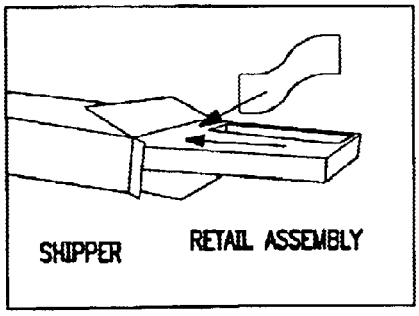

16 Place Retail Assembly into the shipper. Slide 2 loaded units into shipper. Seal shipper. Apply shipping label to outside corner of shipper.

FIG. 16

RECEPTACLE FOR TRAY DISPLAY

BACKGROUND OF THE INVENTION

1. Field of the Invention

The present invention relates to tray displays, for point of purchase display of goods, which displays are often located on or near check-out counters in stores. The present invention is directed in particular to the receptacles or stands that are used for supporting and prominently displaying goods arrayed in trays.

2. The Prior Art

Receptacles for tray displays are used for supporting trays (typically open-topped rectangular parallelepiped containers) that have goods arrayed in them. The goods may be packaged in their own discrete cartons, or may be essentially unpackaged, but separated vertical and/or horizontal dividers in the tray.

It would be desirable to provide a point-of-purchase display for goods which is fabricated from lightweight, recyclable materials, such as paper, paperboard and/or corrugated paperboard.

It would also be desirable to provide a point of purchase display for goods which may be articulated from a compact form suitable for shipping in simple, rectangular parallelepiped cartons, with a minimum of wasted empty space in the carton, to an erected display configuration.

It would also be desirable to provide such a point of purchase display that is provided with a simplified, integrated structure that employs a minimum number of separate components that must be assembled.

These and other desirable characteristics of the present invention will become apparent in view of the present specification and drawings.

SUMMARY OF THE INVENTION

The present invention is directed to a receptacle for a tray display, for point-of-purchase display of articles, comprising an outer shell, an article enclosing tray structure, and an article supporting shelf.

The outer shell includes a front wall, an aperture extending across a portion of the front wall, and two side panels extending from side edges of the front wall.

The article-enclosing tray structure has an open front region, at least a portion of which is aligned with the aperture in said outer shell, a back wall opposite said open front region, a bottom wall extending along a bottom edge region of the back wall, and two side walls, extending along side edge regions of the back wall, said bottom wall and said side walls having front edge regions which are juxtaposed to a rearward-facing side of the front wall, the back wall being disposed in substantially parallel spaced relation to the front wall, to define an article containing space therebetween.

The article supporting shelf is connected to the front wall and extending along at least a portion of a bottom edge region of the aperture, and engaging an intersection between the back wall and the bottom wall of the article-enclosing tray structure.

The side panels are articulable, between a configuration in which first portions of the side panels are folded flat against a rearward facing surface of the back wall to enable facilitated positioning of the receptacle into a shipping container, and a configuration in which second portions of the side panels are folded underneath the bottom wall and other portions of the side panels form supports for maintaining the front wall of the outer shell, and, in turn, the article containing volume, at an inclined angle relative to a horizontal surface, upon which the receptacle may be placed.

In an embodiment of the invention, the outer shell and the article-enclosing tray structure are formed from a single, contiguous blank of sheet material.

In a preferred embodiment of the invention, the outer shell and the article-enclosing tray structure are integrally connected to one another along a bottom edge region of the outer shell and a forward edge region of the bottom wall. In an alternative preferred embodiment of the invention, the outer shell and the article-enclosing tray structure are formed from separate, discrete blanks of sheet material.

The side walls of the article-enclosing tray structure are preferably each formed from a first, outer panel, emanating from a side edge region of the back wall, and a second, folded-over inner panel, emanating from a front edge region of the first, outer panel. Preferably, the second, folded-over inner panels are held in place by tabs emanating from rearwardly facing edges thereof, received in slots formed in side edge regions of the back wall.

Preferably, the first portions of the side panels are foldable along first fold lines extending substantially parallel to side edge regions of the front panel, and the second portions of the side panels are foldable along second fold lines extending at acute angles to the first fold lines.

The receptacle preferably further comprises at least one divider structure received within the article containing volume. The at least one divider structure comprises, in part, a transverse internal divider support, extending substantially parallel to the back wall; and at least one depth internal divider support, disposed at an angle to the planar transverse internal divider support, and interengaged with the planar transverse internal divider support. The at least one divider structure may further comprise a tubular member, having a back wall having a first height, a front wall having a second height less than the first height, and having a top edge disposed substantially aligned with a top edge of the rear wall; and at least one divider flap foldably struck from a portion of the back wall, at least a portion of the at least one divider flap extending below a lower edge of the front wall.

Preferably, the article supporting shelf is cut out from the front wall of the outer shell, remaining foldably connected thereto, and wherein the aperture is exposed, at least in part, when the article supporting shelf is folded out of plane from the front wall of the outer shell. The article supporting shelf may have an area which is smaller than an area of the aperture formed when the article supporting shelf is folded out of plane from the front wall of the outer shell.

The outer shell may further include cutout areas adjoining the aperture to facilitate grasping of articles contained within the receptacle for a tray display.

BRIEF DESCRIPTION OF THE DRAWINGS

FIG. 15 illustrates steps 1–8 in the process for setting up the receptacle of the embodiment of FIG. 8.

FIG. 16 illustrates steps 9–16 in the process for setting up the receptacle of the embodiment of FIG. 8.

DETAILED DESCRIPTION OF THE DRAWINGS

Figure 1:
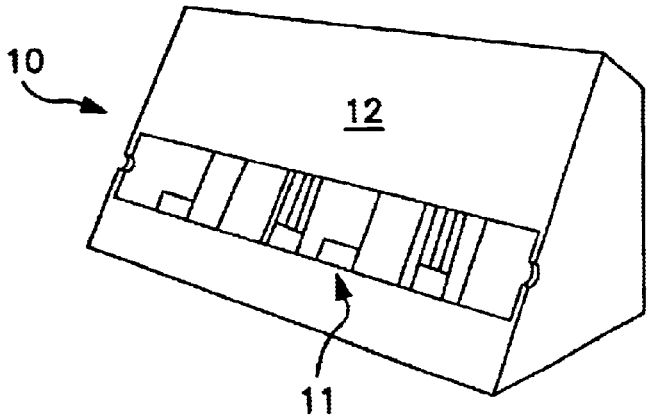
FIG. 1 is a perspective view of an assembled receptacle for a tray display, according to one embodiment of the invention.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

In preferred embodiments of the invention, the blanks illustrated herein are formed from paper, paperboard and/or corrugated paperboard material, although other materials, having similar properties may be employed if desired. Specifically, although the outer shell structures described herein are preferably fabricated from corrugated paperboard, the tray structures (particularly the discrete, separate tray) may be fabricated from plastic material.

Unless otherwise stated, in the drawings the convention will be observed that within the borders of an illustration of a blank, broken or dotted lines indicate fold lines, score lines or other lines of weakness, while solid lines indicate cuts or apertures.

Figure 2:
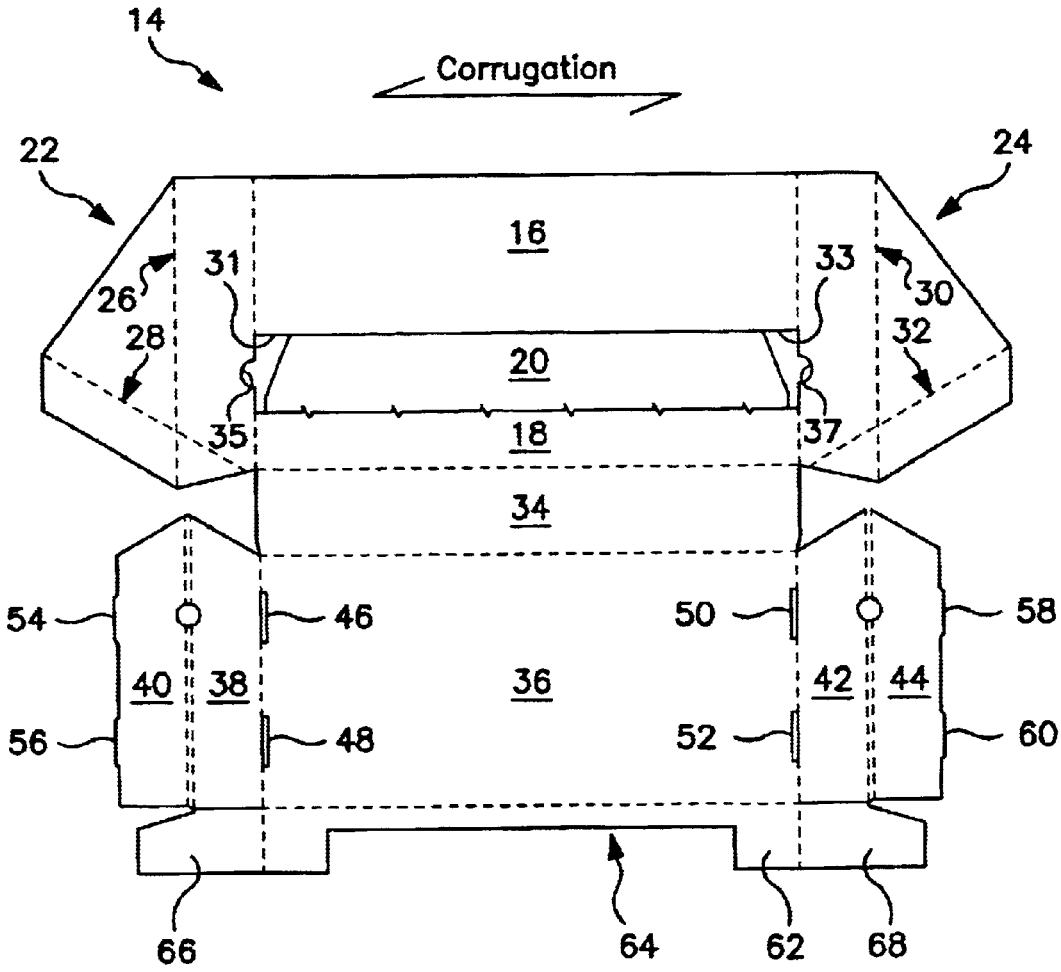
FIG. 2 is a plan view of the blank for the outer shell for the receptacle for the embodiment of FIG. 1.

FIG. 1 is a perspective view of an assembled receptacle for a tray display, according to one embodiment of the invention. Receptacle 10 includes an outer shell 12, formed from blank 14 (FIG. 2). Blank 14 includes front wall upper portion 16 and front wall lower portion 18 (upon which product-related graphics may be placed), and pivotable shelf 20. In the embodiment of FIG. 2, shelf 20 is essentially trapezoidal, and has gaps 31, 33 on either side, as well as finger access notches 35, 37. When shelf 20 is pivoted, a side-to-side aperture 11 (see FIG. 1) for access to the articles in the receptacle, is created. Side panels 22, 24 include intersecting fold lines 26, 28, 30, 32. Blank 14 further includes bottom panel 34, rear panel 36, first inner side panels 38, 42 and second inner side panels 40, 44, slots 46, 48, 50, 52 and tabs 54, 56, 58 and 60. Blank 14 further includes top panel 62, with notch 64; and top flaps 66, 68.

Figure 3:
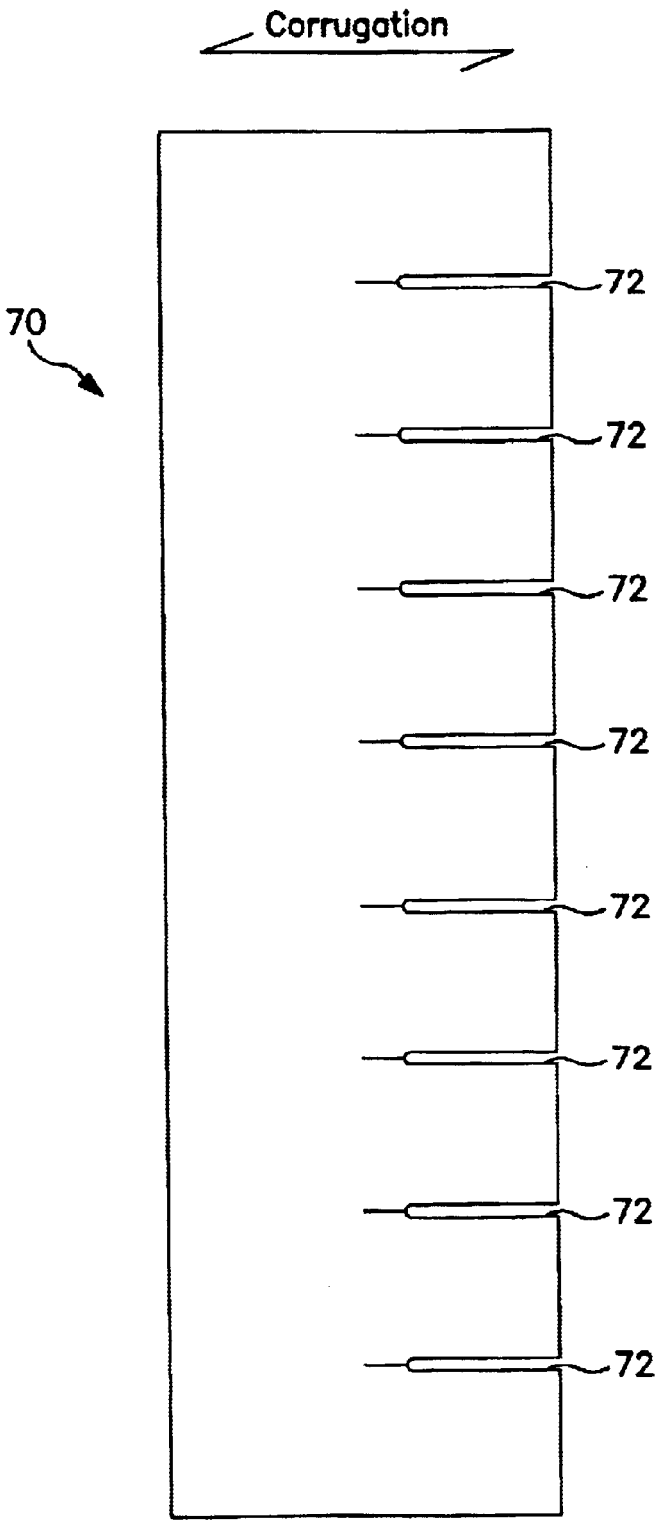
FIG. 3 is a plan view of a blank for the transverse internal divider support, for use with the outer shell of the embodiment of FIG. 1.
Figure 4:
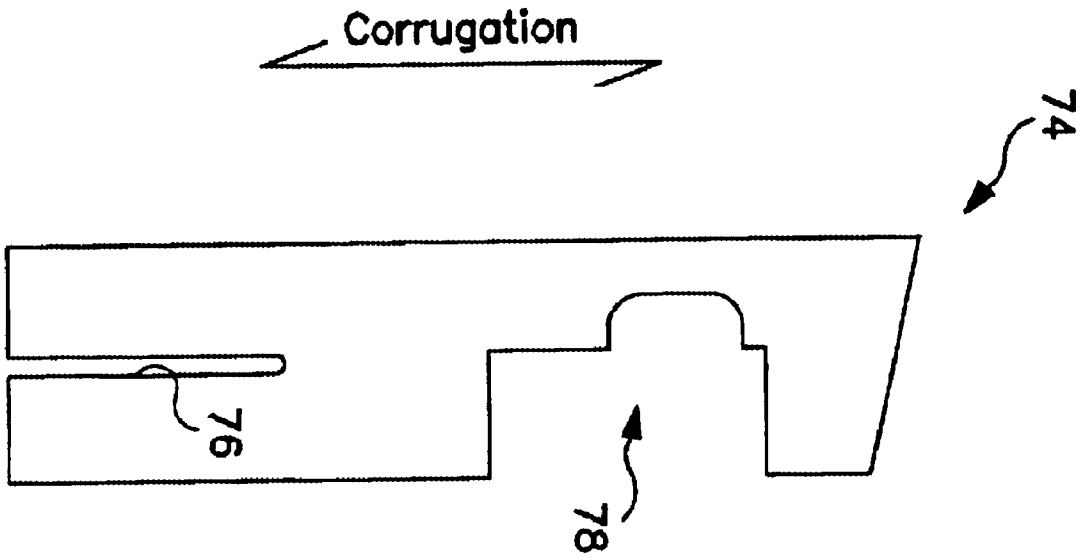
FIG. 4 is a plan view of a blank for the depth internal divider support, for use with the outer shell of the embodiment of FIG. 1.

FIG. 3 is a plan view of a blank for the transverse internal divider support 70, for use with the outer shell 12 of the embodiment of FIG. 1. Transverse internal divider support 70 includes a plurality of slots 72. FIG. 4 is a plan view of a blank for the depth internal divider support 74, each of which includes a slot 76 and a notch 78, for use with the outer shell 12 of the embodiment of FIG. 1. As many depth internal divider supports 74 will be provided as there are slots 72 in the transverse internal divider support 70.

Figure 5:
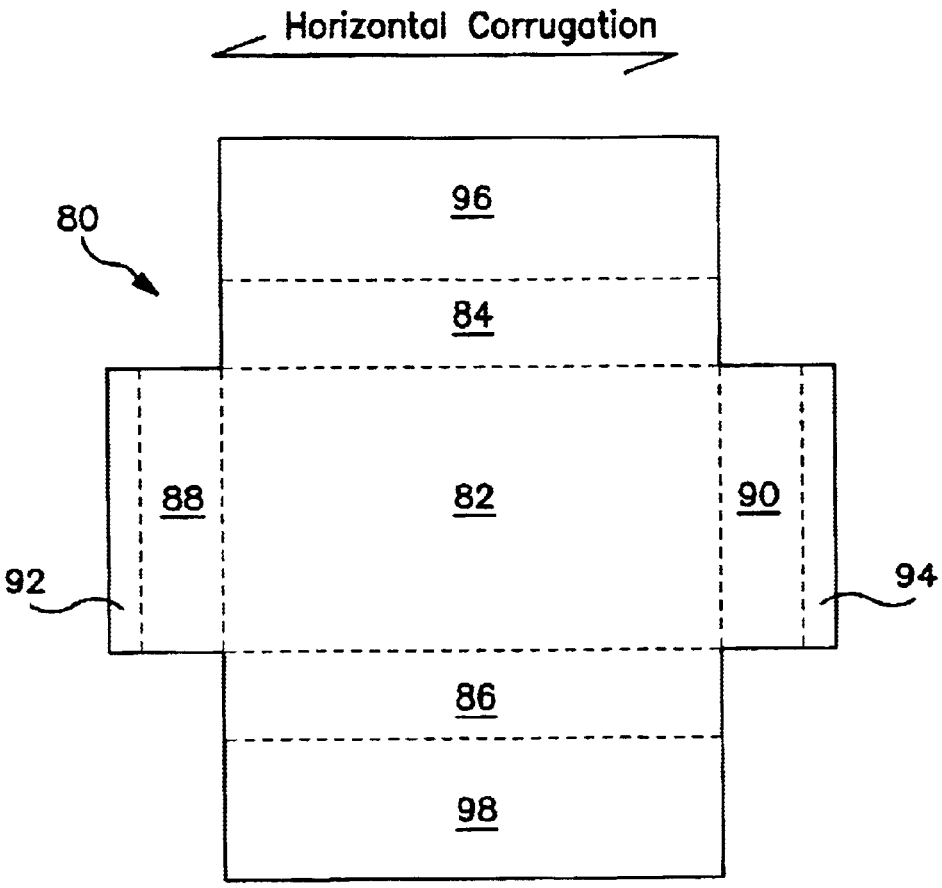
FIG. 5 is a plan view of a blank for an outer shipper carton, for use with the receptacle of FIG. 1.

FIG. 5 is a plan view of a blank 80 for an outer shipper carton, for use with the receptacle 10 of FIG. 1. Blank 80 includes bottom panel 82; side panels 84, 86; end panels 88, 90; support panels 92, 94; and top panels 96, 98.

Assembly of receptacle 10 begins by inserting depth internal divider supports 74 onto transverse internal divider supports, notch-to-notch until the respective bottoms of the respective notches come into contact.

Formation of the outer shell 12 begins by forming the "tray" portion, into which the assembled internal divider will be placed. Top panel 62 is folded perpendicular to back panel 36, and then tabs 66, 68 are folded perpendicular to top panel 62, to extend along the end edges of back panel 36. First inner side panels 38, 42 are then folded perpendicular to bottom panel 36, and then second inner side panels 40, 44 are folded down, to the inside of first inner side panels 38, 42, until tabs 54, 56, 58 and 60 are received within slots 46, 48, 50, 52. Flaps 66, 68 will be captured between panels 38, 40; and 42, 44, respectively.

Figure 18:
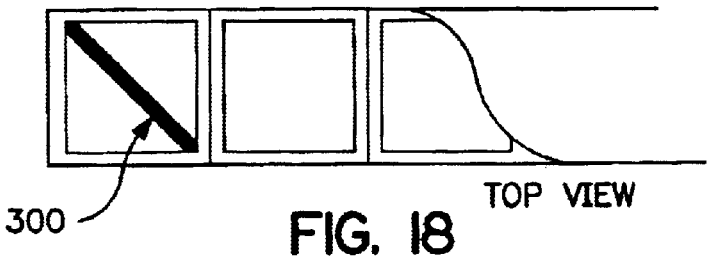
FIG. 18 is a top view of the display shown in FIG. 17, partially in section.
Figure 17:
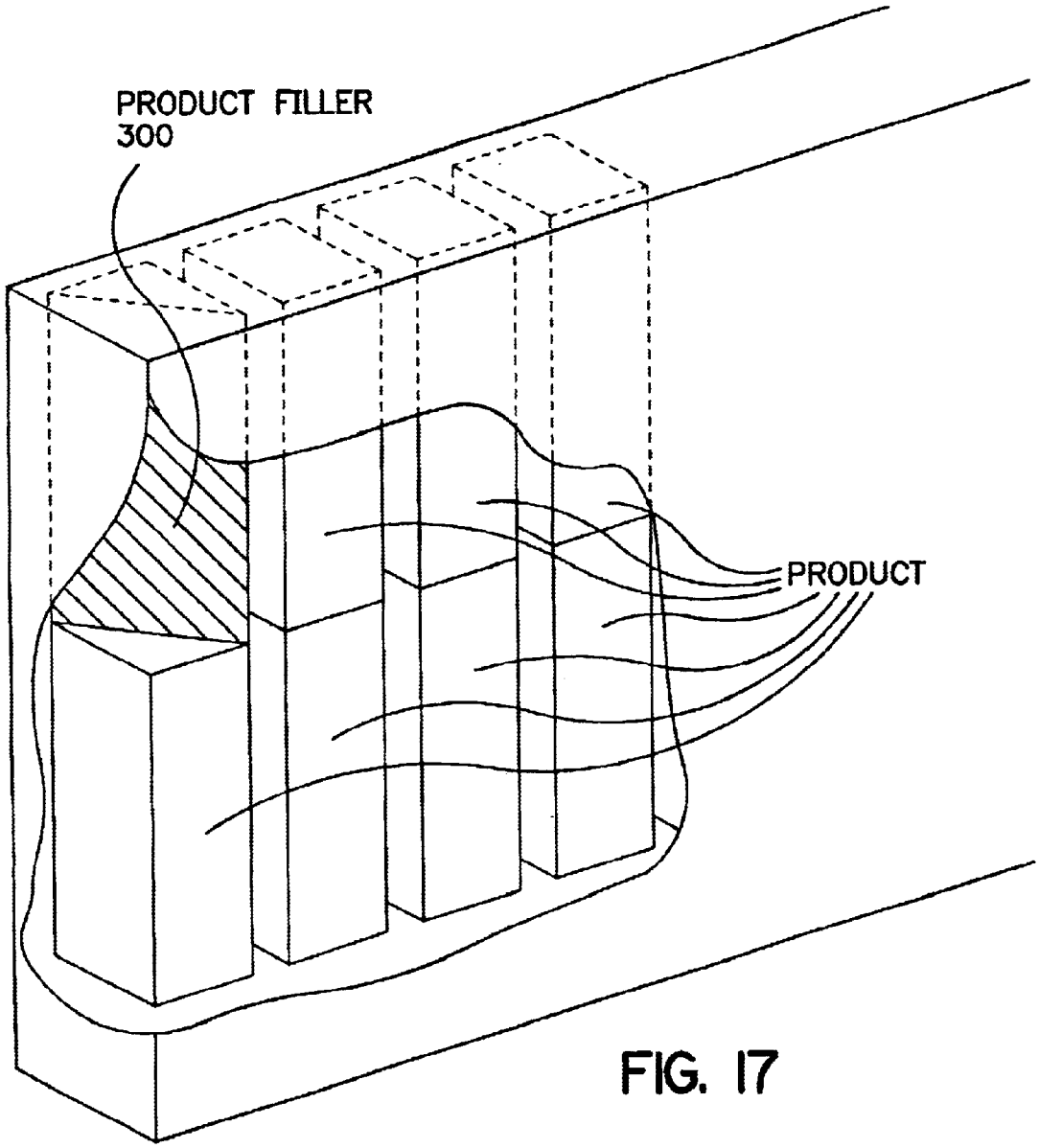
FIG. 17 is a perspective view, partially in section, of a display, showing the use of a product filler, to occupy space above individual product containers.

At this point in the procedure, the internal divider structure, with the products to be displayed (typically small rectangular parallelepiped cartons) can be placed in the tray portion of the outer shell, with the internal divider being oriented such that the angled ends of the depth internal divider supports 74 are pointed down, with the bottom edges angling upwardly from front to rear. Then, bottom panel 34 is folded to an oblique angle relative to back panel 36, until front wall lower portion 18 (with front wall upper portion 16 moving with it) can be folded parallel to back panel 36. If the mostly assembled receptacle 10 is to be shipped, then side panels 22, 24 are folded perpendicular to front wall portions 16 and 18, and then folded again, about fold lines 26, 30, so that the trapezoidal outer portions of panels 22, 24 are folded behind and in overlying relation to back panel 36. Because the products that are inserted may be shorter in height than the space provided, permitting the products to be stacked atop one another in columns of two or more, as shown in FIG. 17. It may be that not all of the vertical space may be required. If the display is to be filled prior to shipment, it would be desirable to prevent such underfilled displays from experiencing sliding or other movement of the product. Therefore, a "product filler" 300 (FIG. 18) may be provided, which may simply be a rectangular blank having a width that is the diagonal distance of the space to be filled. The product filler 300 may not be used in every instance, and its size and shape may vary according to the particular application. The product filler may be used with this embodiment, or the second embodiment of the invention described hereinbelow.

For shipment, the thus-folded receptacle 10 is placed on bottom panel 82 of shipper 80. End panels 88, 90 are folded up perpendicular to bottom panel 82; support panels 92, 94 are folded parallel to bottom panel 82; side panels 84, 86 are folded perpendicular to bottom panel 82, and finally top panels 96, 98 are folded inwardly, parallel to bottom panel 82, overlying support panels 92, 94, and affixed in place, typically by tape.

When receptacle 10 is at its final destination and ready for display, side panels 22, 24 are flattened out, so that front wall portions 16, 18 can be pivoted away from back panel 36. Shelf panel 20 is folded inwardly, until the rear free edge of shelf panel 20 is pivoted down to the crease formed between back panel 36 and bottom panel 34, describing an included angle between them which is the same angle as between the rear edges and the bottom edges of the depth internal divider supports 74, those bottom edges being positioned to rest on the upper surface of now-deployed shelf panel 20. Front wall portions 16, 18 are then folded back over to the position parallel to back panel 36. Side panels 22, 24 are folded perpendicular to front wall portions 16, 18, and are then folded about fold lines 28, 32, so that the narrow trapezoidal portions at the bottoms of side panels 22, 24 are folded underneath the bottom panel 34, creating an easel effect, so that front wall portions 16, 18 extend at an inclined angle relative to the horizontal. Although the weight of the receptacle 10, and the contained products might be sufficient to keep side panels 22, 24 in place, in alternative embodiments, tape or adhesive may be used, to keep side panels 22, 24 in close contact with the outer surfaces of first inner side panels 38, 42, and to keep the trapezoidal portions of side panels 22, 24, that are below fold lines 28, 32, in contact with the outer surface of bottom panel 34.

Figure 6:
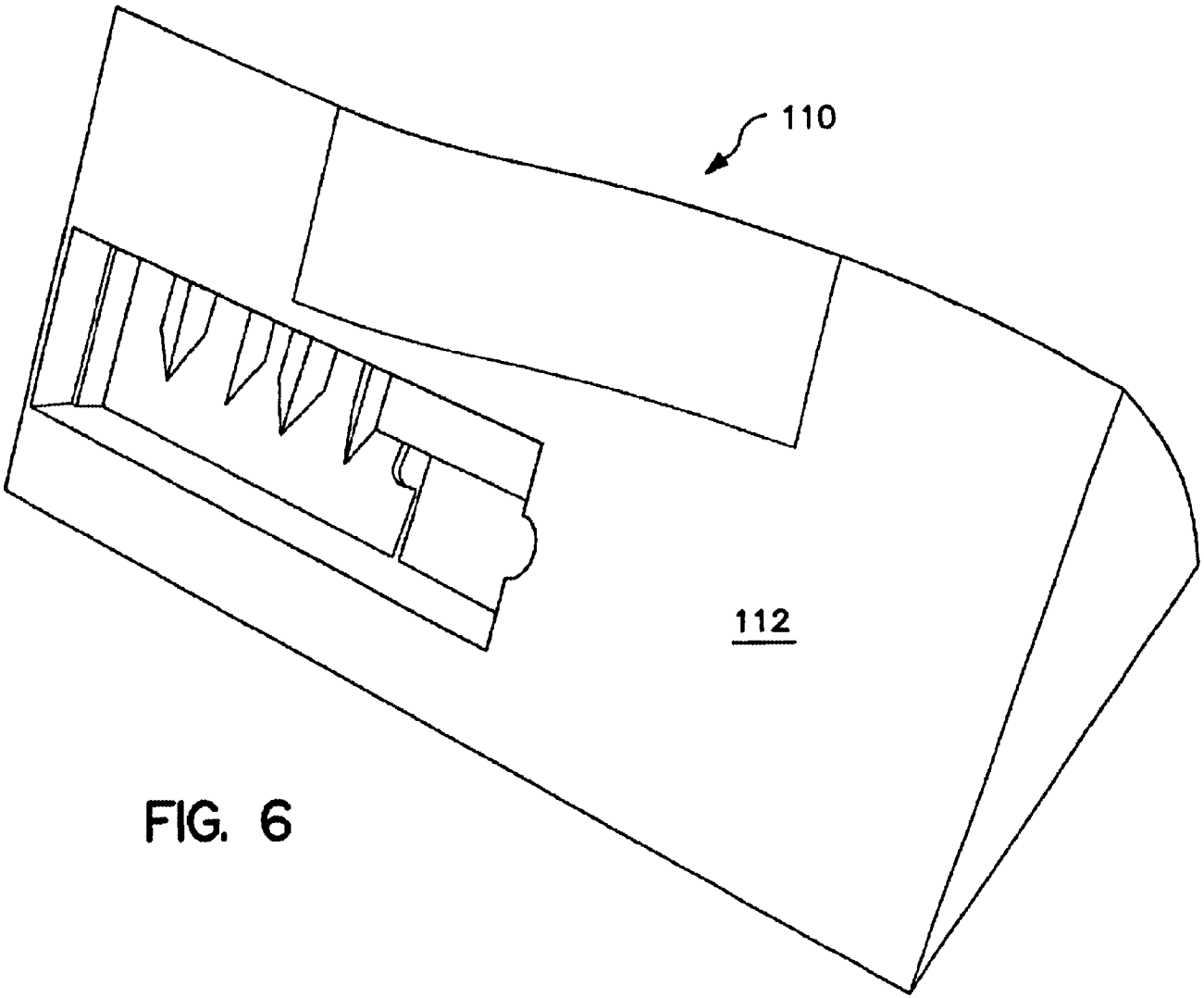
FIG. 6 is a perspective view of an assembled receptacle for a tray display, according to another embodiment of the invention.
Figure 7:
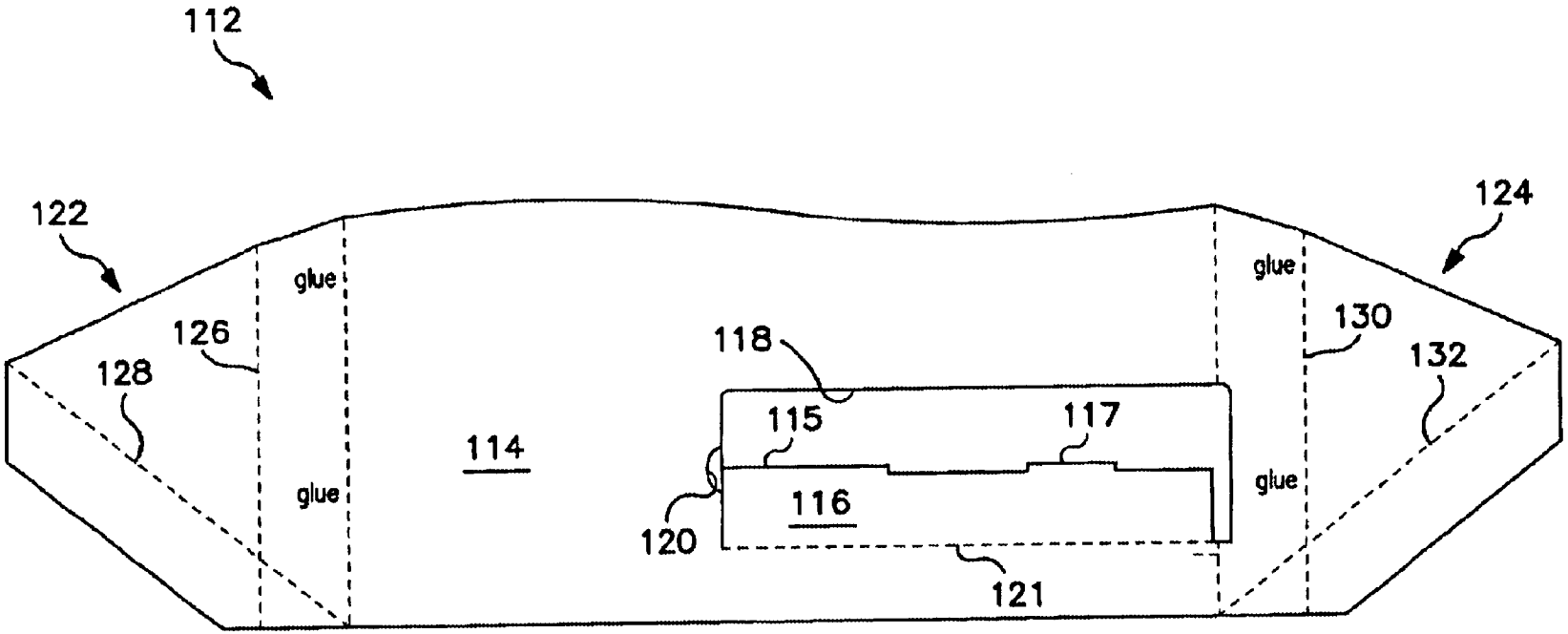
FIG. 7 is a plan view of the blank for the outer shell for the receptacle for the embodiment of FIG. 6.

An alternative embodiment of the invention is disclosed in FIGS. 6–16. FIG. 6 is a perspective view of an assembled receptacle 110 for a tray display, according to another embodiment of the invention. Receptacle 110 includes outer shell 112, which, as seen from the inside in FIG. 7, comprises front wall 114, with shelf panel 116 and opening 118, and thumb/finger hole 120; side panels 122 and 124, with intersecting fold lines 126, 128, 130 and 132; top panel 134, top flap 135, and opening 137.

Figure 8:
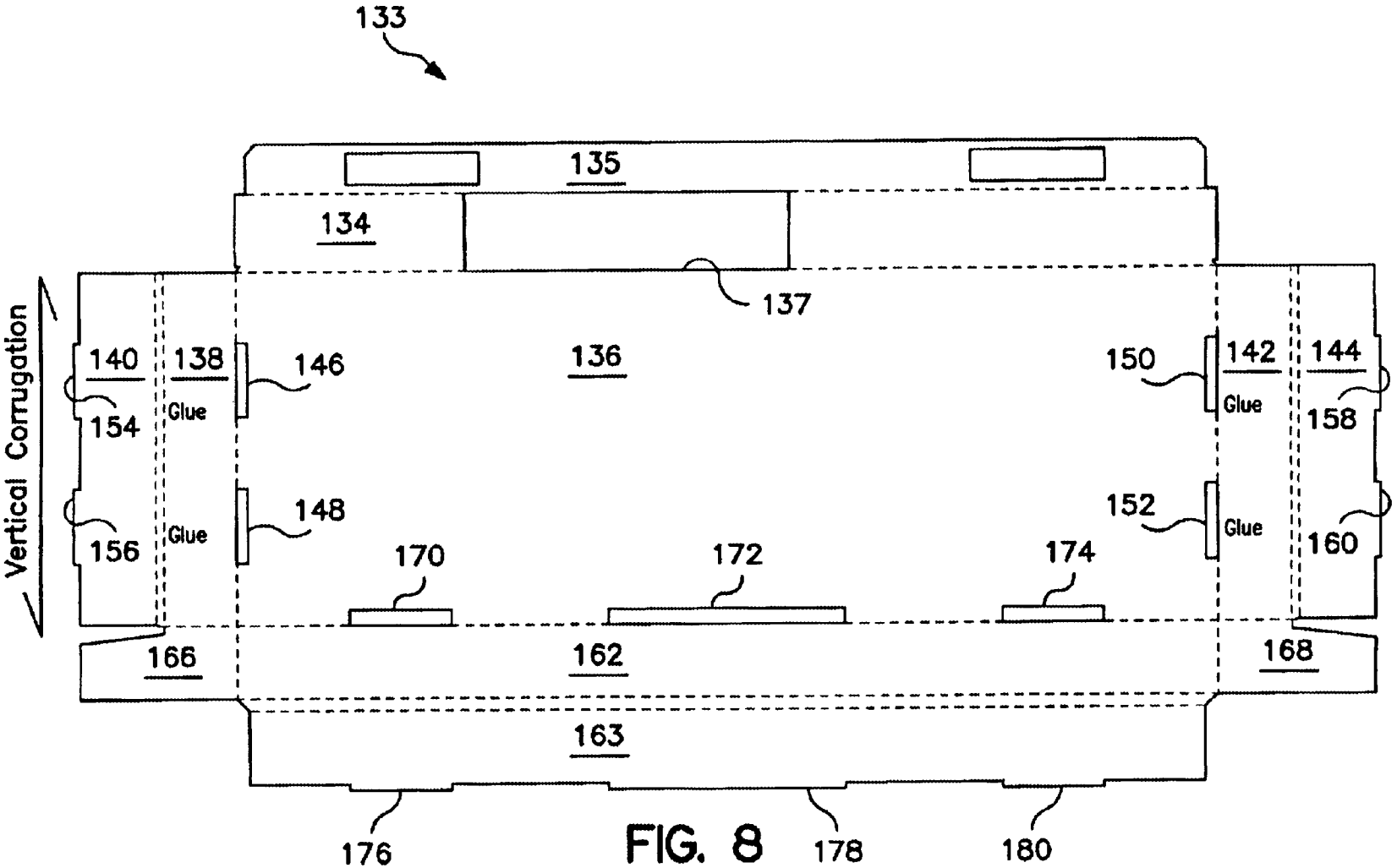
FIG. 8 is a plan view of the blank for the interior tray for use with the receptacle for the embodiment of FIG. 6.

FIG. 8 is a plan view of the blank for the interior tray for use with the receptacle for the embodiment of FIG. 6. Blank 133 includes bottom panel 134, rear panel 136, first inner side panels 138, 142 and second inner side panels 140, 144, slots 146, 148, 150, 152 and tabs 154, 156, 158 and 160. Blank 133 further includes outer top panel 162, and inner top panel 163; and top flaps 166, 168, and notches 170, 172, 174, and tabs 176, 178, 180.

Figure 9:
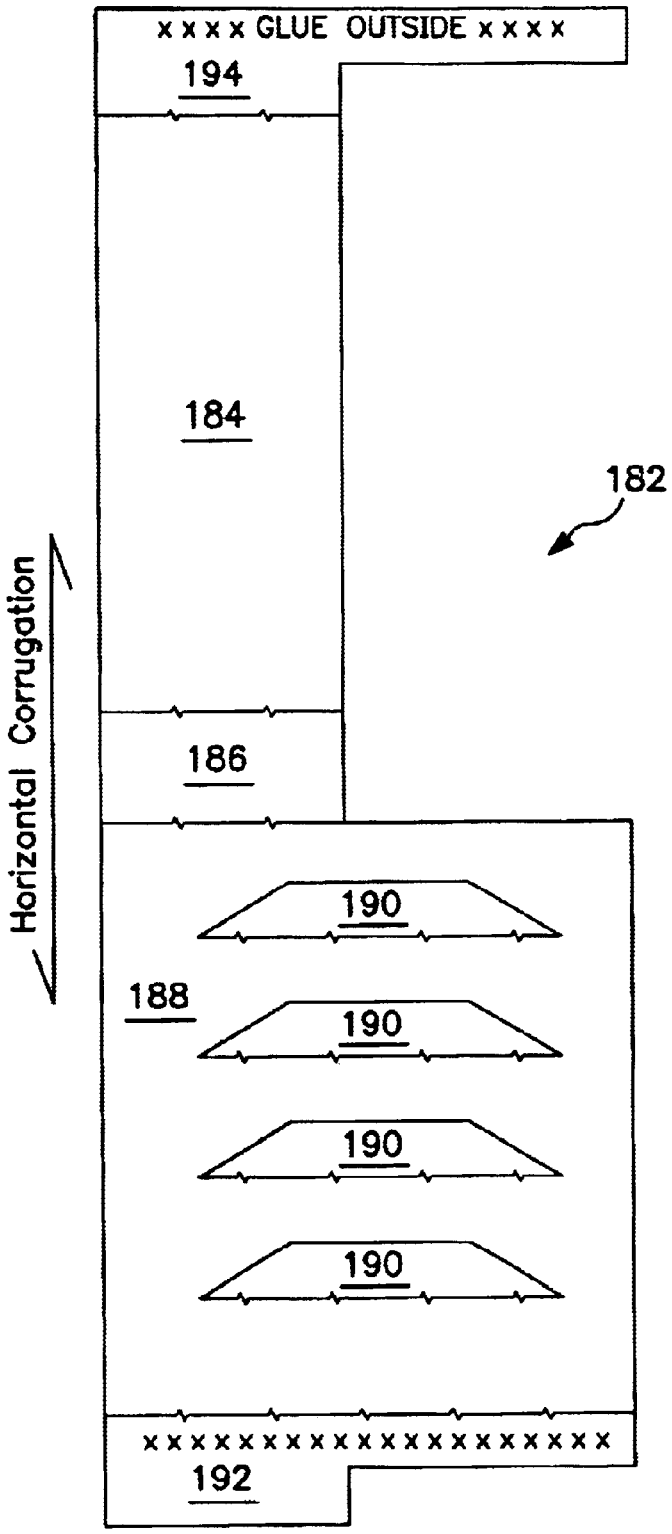
FIG. 9 is a plan view of the blank for the small carton divider for use with the receptacle for the embodiment of FIG. 8.

FIG. 9 is a plan view of the blank 182 for the small carton divider for use with the receptacle for the embodiment of FIG. 8. Blank 182 includes front wall 184, side wall 186, rear wall 188 with divider flaps 190, first glue flap 192 and second glue flap 194.

Figure 10:
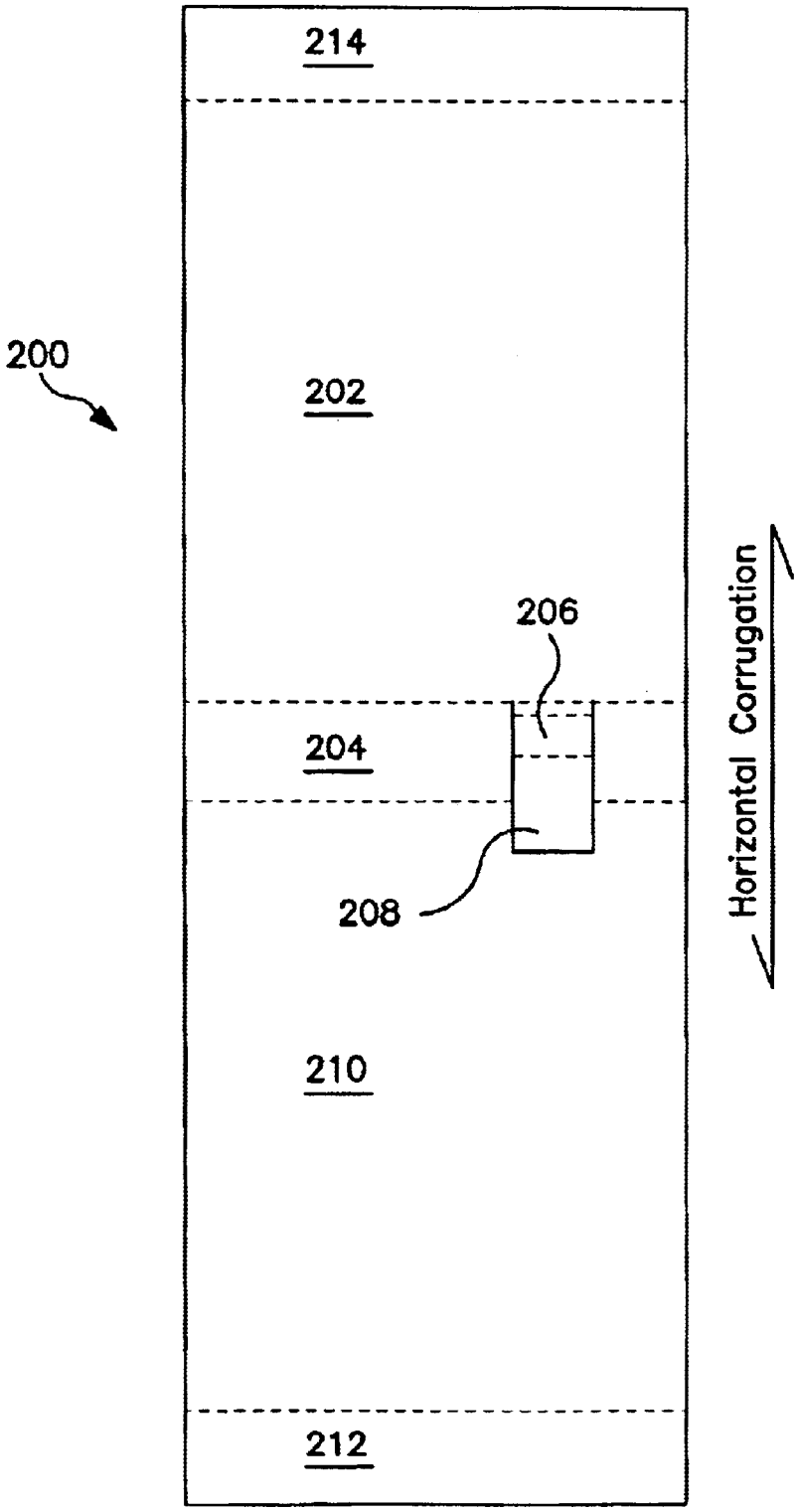
FIG. 10 is a plan view of the blank for a tray insert for use with the receptacle for the embodiment of FIG. 8.

FIG. 10 is a plan view of the blank 200 for a tray insert for use with the receptacle for the embodiment of FIG. 8. Blank 200 includes front wall 202; side wall 204 with articulating panels 206, 208; back wall 210; first glue flap 212 and second glue flap 214.

Figure 11:
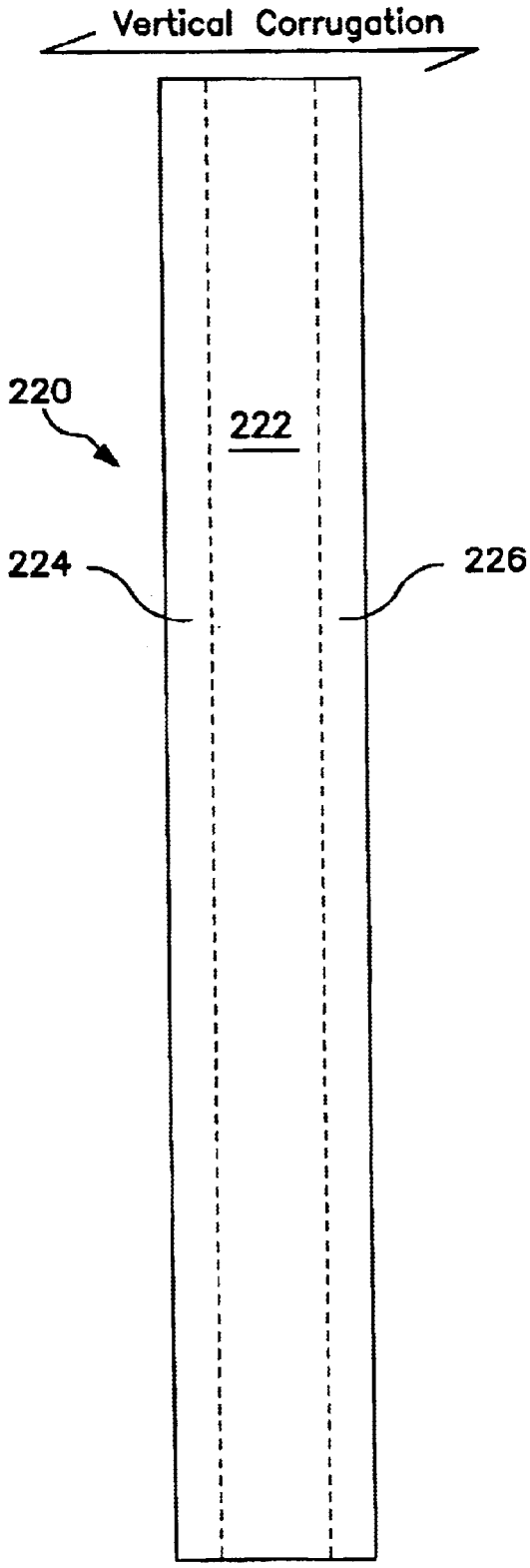
FIG. 11 is a plan view of the blank for a top filler for use with the receptacle for the embodiment of FIG. 8.

FIG. 11 is a plan view of the blank 220 for a top filler for use with the receptacle for the embodiment of FIG. 8. Top filler 220 includes center panel 222 and side strip panels 224, 226.

Figure 12:
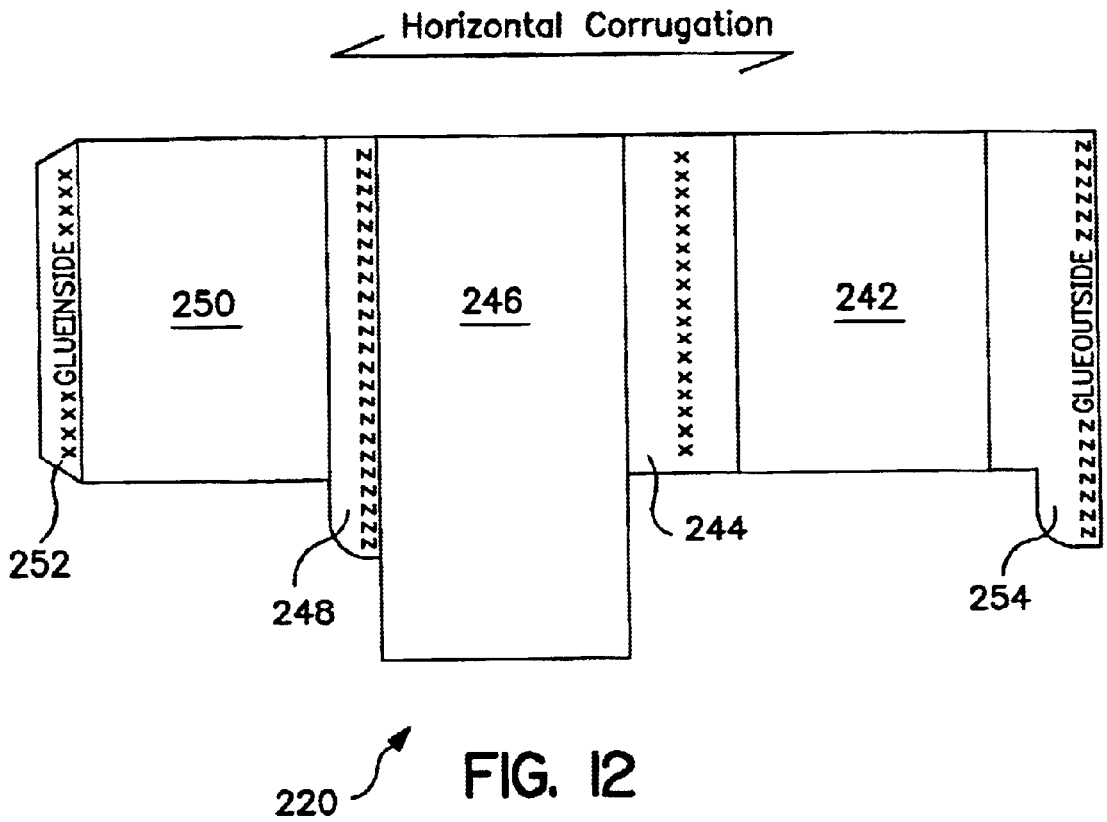
FIG. 12 is a plan view of the blank for another divider for use with the receptacle for the embodiment of FIG. 8.

FIG. 12 is a plan view of the blank 240 for another divider for use with the receptacle for the embodiment of FIG. 8. Blank 240 includes front panel 242, side panel 244, rear panel 246, panel 248, reinforcement panel 250, glue flap 252 and glue flap 254.

Figure 13:
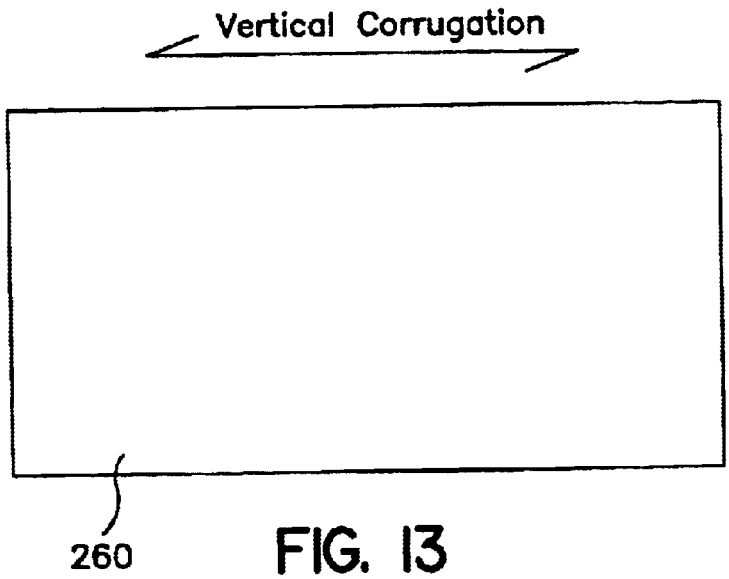
FIG. 13 is a plan view of the blank for another filler for use with the receptacle for the embodiment of FIG. 8.

FIG. 13 is a plan view of the blank 260 for another filler for use with the receptacle for the embodiment of FIG. 8.

Figure 14:
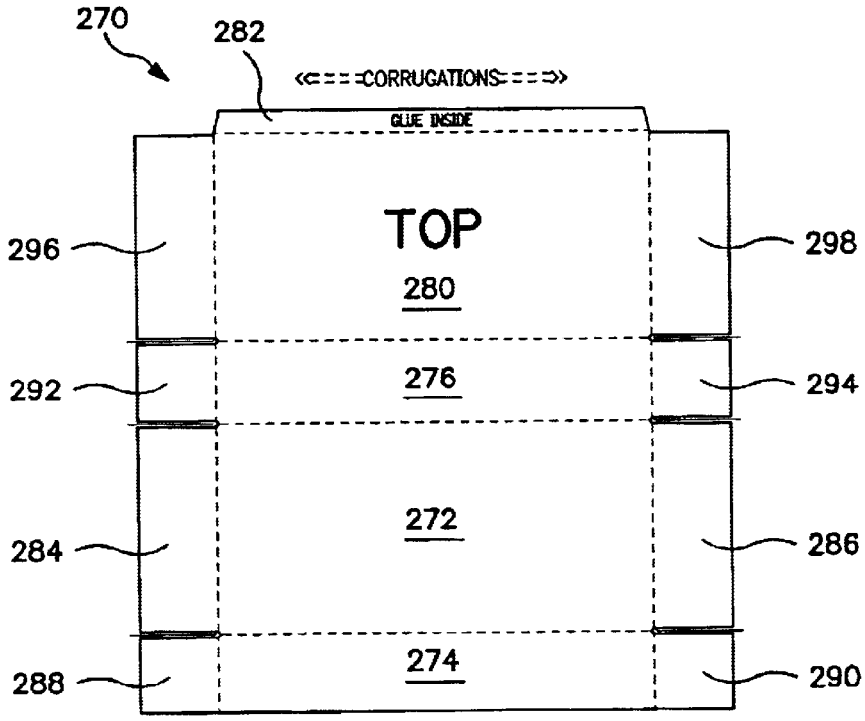
FIG. 14 is a plan view for a shipper for use with the receptacle of the embodiment of FIG. 8.

FIG. 14 is a plan view for a shipper 270 for use with the receptacle of the embodiment of FIG. 8. Shipper 270 includes bottom panel 272; front panel 274; rear panel 276; top panel 280; glue flap 282; bottom panel flaps 284, 286; front panel flaps 288, 290; rear panel flaps 292, 294; and top panel flaps 296, 298.

FIG. 15 illustrates steps 1–8 in the process for setting up the receptacle of the embodiment of FIG. 8. FIG. 16 illustrates steps 9–16 in the process for setting up the receptacle of the embodiment of FIG. 8.

Assembly is accomplished by first forming tray 133. Panel 162 is folded perpendicular to bottom panel 136, and then panel 163 is folded over until tabs 176, 178, 180 engage slots 170, 172, 174. Flaps 166 and 168 are folded inwardly. Panels 138, 142 are folded perpendicular to bottom panel 136 (and against flaps 166, 168), and then panels 140, 144 are folded inwardly until tabs 154, 156, 158, 160 engage slots 146, 148, 150, 152. Preferably, a suitable double-sided tape, such as that sold under the name Twinstick, is placed on the outside surface of panel 135. Further such double-sided tapes will be affixed to the outside facing surfaces of panels 138, 142. Tray 133 is then flipped over and placed on the inside surface of outer shell 112, and aligned so that the bottom surface of bottom panel 162 is substantially aligned with fold line 121 of outer shell 112.

Side panels 122, 124 are then folded back over side panels 138, 142 and adhered thereto, using the aforementioned double-sided tape structures. Shelf panel 115 is folded backwards toward back wall 136, so that tabs 115, 117 are received in slots 172, 170, respectively.

Blank 200 is then folded, as shown in FIGS. 15–6 to form a rectangular tube, with glue flaps 212, 214 overlying and adhered to one another. Once formed tube 200 is inserted into the gap between outer shell 112, and back wall 136, and to the side of opening 118.

Blank 240 is then folded likewise into a tube, with flap 254 overlying panel 248, and flap 252 overlying and adhered to panel 244. Once formed, the divider 240 will be inserted into the gap between outer shell 112, and back wall 136, and to the side of tube 200.

Blank 182 is folded into a tube, until flap 192 overlies and is adhered to flap 194. Divider panels 190 are pulled out from back panel 188. Once formed, divider 182 is inserted into the gap between outer shell 112, and back wall 136, and to the side of tube 240, with the orientation that front panel 184 will be above divider panels 190.

Top filler 220 is formed by folding strip panels 224, 226 perpendicular to center panel 222, and then inserted into the remaining space above the divider structures already inserted into the receptacle.

Top panel 134 is then folded over the opening above the gap between outer shell 112, and back wall 136, and panel 135 is tucked behind the top edge of front panel 114. Later, when actual product is put into the receptacle, panel 135 will be adhered to the back side of panel 114, preferably with double-sided tape structures, previously placed on the outer surface of panel 135. Side flaps 122, 124 are folded along fold lines 126, 130, so that the remaining portions are folded along the back wall 136.

Shipper 270 is preferably formed by folding the bottom panel 272, front panel 274, rear panel 276, top panel 280 and glue flap 282 into a tube, and closing one end by folding over flaps 288, 284, 292 and 296. Thereafter, one or more of the receptacles (depending upon the dimensions and proportions of shipper 270) are inserted into shipper and the remaining flaps are closed.

Upon arrival at the destination, and filling with product (if not already done so), side panels 122, 124 are straightened out, and then folded along fold lines 128, 132, to create the easel effect, as described with respect to the first embodiment.

In alternative embodiments of the invention, instead of the internal divider structures shown, alternative tray structures may be inserted into the volume between the back wall and the front wall of the outer shell, which may be fabricated from any suitable material, such as molded plastic, or paper, paperboard or corrugated paperboard.

The present invention is believed to have a number of benefits over prior art displays. First, the receptacles are configured for conversion from a compact configuration in which the side panels of the outer shell are folded over the back of the tray portion, thus permitting efficient packing within simple standard shipping carton structures, to a display configuration, in which the side panels, with their bottom flaps folded, form an attractive, eye-catching easel configuration. Second, the receptacle, when in the display configuration, has an enlarged footprint, which enables it to occupy maximum shelf space, while keeping product "up front" and preventing product from being pushed back to the rear of a shelf area.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A receptacle for a tray display, for point-of-purchase display of articles, comprising:

an outer shell, including a front wall, an aperture extending across a portion of the front wall, and two side panels extending from side edges of the front wall;

an article-enclosing tray structure, having an open front region, at least a portion of which is aligned with the aperture in said outer shell, a back wall opposite said open front region, a bottom wall extending along a bottom edge region of the back wall, and two side walls, extending along side edge regions of the back wall, said bottom wall and said side walls having front edge regions which are juxtaposed to a rearward-facing side of the front wall, the back wall being disposed in substantially parallel spaced relation to the front wall, to define an article containing space therebetween;

an article supporting shelf, connected to the front wall and extending along at least a portion of a bottom edge region of the aperture, and engaging an intersection between the back wall and the bottom wall of the article-enclosing tray structure;

the side panels being articulable, between a configuration in which first portions of the side panels are folded flat against a rearward facing surface of the back wall to enable facilitated positioning of the receptacle into a shipping container, and a configuration in which second portions of the side panels are folded underneath the bottom wall and other portions of the side panels form supports for maintaining the front wall of the outer shell, and, in turn, the article containing volume, at an inclined angle relative to a horizontal surface, upon which the receptacle may be placed.

2. The receptacle according to claim 1, wherein the outer shell and the article-enclosing tray structure are formed from a single, contiguous blank of sheet material.

3. The receptacle according to claim 1, wherein the outer shell and the article-enclosing tray structure are integrally connected to one another along a bottom edge region of the outer shell and a forward edge region of the bottom wall.

4. The receptacle according to claim 1, wherein the outer shell and the article-enclosing tray structure are formed from separate, discrete blanks of sheet material.

5. The receptacle according to claim 1, wherein the side walls of the article-enclosing tray structure are each formed from a first, outer panel, emanating from a side edge region of the back wall, and a second, folded-over inner panel, emanating from a front edge region of the first, outer panel.

6. The receptacle according to claim 5, wherein the second, folded-over inner panels are held in place by tabs emanating from rearwardly facing edges thereof, received in slots formed in side edge regions of the back wall.

7. The receptacle according to claim 1, wherein the first portions of the side panels are foldable along first fold lines extending substantially parallel to side edge regions of the front panel, and the second portions of the side panels are foldable along second fold lines extending at acute angles to the first fold lines.

8. The receptacle according to claim 1, further comprising at least one divider structure received within the article containing volume.

9. The receptacle according to claim 8, wherein the at least one divider structure comprises:

a transverse internal divider support, extending substantially parallel to the back wall; and at least one depth internal divider support, disposed at an angle to the planar transverse internal divider support, and interengaged with the planar transverse internal divider support.

10. The receptacle according to claim 8, wherein the at least one divider structure comprises:

a tubular member, having a back wall having a first height, a front wall having a second height less than the first height, and having a top edge disposed substantially aligned with a top edge of the rear wall; and at least one divider flap foldably struck from a portion of the back wall, at least a portion of the at least one divider flap extending below a lower edge of the front wall.

11. The receptacle for a tray display, according to claim 1, wherein the article supporting shelf is cut out from the front wall of the outer shell, remaining foldably connected thereto, and wherein the aperture is exposed, at least in part, when the article supporting shelf is folded out of plane from the front wall of the outer shell.

12. The receptacle for a tray display, according to claim 11, wherein the article supporting shelf has an area which is smaller than an area of the aperture formed when the article supporting shelf is folded out of plane from the front wall of the outer shell.

13. The receptacle for a tray display, according to claim 1, wherein the outer shell further includes cutout areas adjoining the aperture to facilitate grasping of articles contained within the receptacle for a tray display.

* * * * *